United States Patent [19]

Belanger, deceased et al.

[11] Patent Number: 4,609,112

[45] Date of Patent: Sep. 2, 1986

[54] FILING APPARATUS

[76] Inventors: Joseph A. A. Belanger, deceased, late of Houston, Tex.; by Claude M. Belanger, executor, 3125 Cedarwood Village Pl., Pensacola, Fla. 32504

[21] Appl. No.: 674,765

[22] Filed: Nov. 26, 1984

[51] Int. Cl.[4] ..... A47F 7/00

[52] U.S. Cl. ..... 211/45; 40/359; 211/50

[58] Field of Search ..... 211/45, 50, 41, 40; 40/378, 377, 405, 359, 360, 23 A

[56] References Cited

U.S. PATENT DOCUMENTS

| | | | |
|---|---|---|---|
| 854,069 | 5/1907 | Williams | 40/359 |
| 2,248,396 | 7/1941 | Terry | 211/50 X |
| 3,365,067 | 1/1968 | Miller et al. | 211/45 |
| 4,236,768 | 12/1980 | Morrone | 211/50 X |

FOREIGN PATENT DOCUMENTS

| | | | |
|---|---|---|---|
| 80036 | 10/1955 | Denmark | 211/40 |
| 1180907 | 3/1955 | Fed. Rep. of Germany . | |

*Primary Examiner*—Robert W. Gibson, Jr.
*Attorney, Agent, or Firm*—George A. Bode

[57] ABSTRACT

A depository for storing flexible sheets comprising: a base and upstanding parallel side walls and curvilinear shaped parallel front and rear walls forming a chamber having an opened face, a plurality of parallel spaced-apart vertical curvilinear dividers cooperating with the side walls and positioned between the front and rear walls to define a plurality of compartments adapted to retain individual sheets in spaced relation, each of the dividers having a side edge formed with a notch therein extending inwardly and downwardly from an upper corner of the divider, the notches in each of the dividers being at substantially the same horizontal and vertical position when the dividers are positioned between the front and rear wall members, and a tab secured to each of the dividers and displayed in the notch in each of the dividers whereby indexing is provided.

9 Claims, 3 Drawing Figures

FILING APPARATUS

BACKGROUND OF THE INVENTION

1. General Background

The invention relates to the art of depositories for filing documents, and more particularly to a depository having a plurality of spaced curvilinear arcuate dividers and indexing tabs for filing control.

2. Prior Art

A depository having a plurality of spaced-apart arcuate dividers so that flexible x-ray film can be inserted between any two dividers so that it will assume the arcuate shape of the dividers and not buckle or be otherwise mutilated in storage is taught by U.S. Pat. No. 3,365,067, issued to G. A. Miller, et al.

U.S. Pat. No. 2,248,396, entitled "Shaper For Tabulating Maching Cards" issued to A. E. Terry and teaches a filing cabinet having spaced-apart elements in each drawer having curved portions so that cards filed will be straight when removed.

German Pat. No. 1,180,907 teaches an apparatus for filing papers on end in a curvilinear manner by having curved supports.

GENERAL DISCUSSION OF THE PRESENT INVENTION

Prior art vertical filing depositories allow sheets deposited therein to curl at the bottom of the compartment leaving the sheet mutilated when removed. Prior art which provides for curved partitions or dividers spaced apart solve this problem, however, do not provide for indexing.

It is therefore an object of the present invention to provide a depository which overcomes the disadvantages of the prior art construction.

It is another object of the present invention to provide a depository wherein flexible, relatively thin paper or sheets may be filed and which do not bend or curl therein.

It is still another object of the present invention to provide a depository for flexible sheets which facilitates filing, removal and refiling of the papers in the depository by providing an indexing means.

The depository for flexible sheets of the present invention comprises a base and upstanding parallel side wall member and curvilinear shape parallel front and rear wall members forming a chamber having an open upper face, a plurality of parallel spaced-apart vertical curvilinear dividers cooperating with the side wall members and positioned between the front and rear wall members to define a plurality of compartments adapted to retain individual sheets in spaced relation, each of the dividers having a side edge formed with a notch therein extending inwardly and downwardly from an upper corner of the divider, the notch being at substantially the same horizontal and vertical position on each of the dividers when positioned between the front and rear wall members, and indexing means coupled to the documents to be filed including a tab secured to the documents whereby the tab is displayed in the notch.

It is still another object of the present invention to provide indexing means which are curvilinear in the direction of their length.

It is a further object of the present invention to provide side wall members which are flexible and thus expandable.

It is a further object of the present invention to provide dividers which cooperate with the side wall to increase the spacing between consecutive side wall as the side wall members expand.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
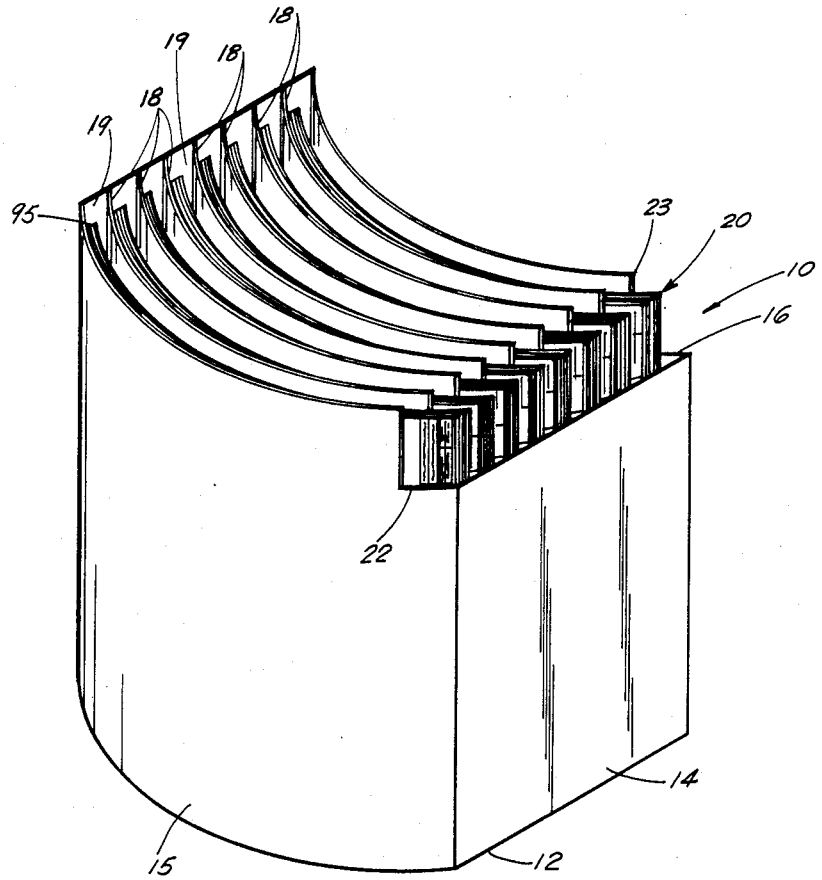
FIG. 1 is a perspective view of the apparatus of the present invention.
Figure 2:
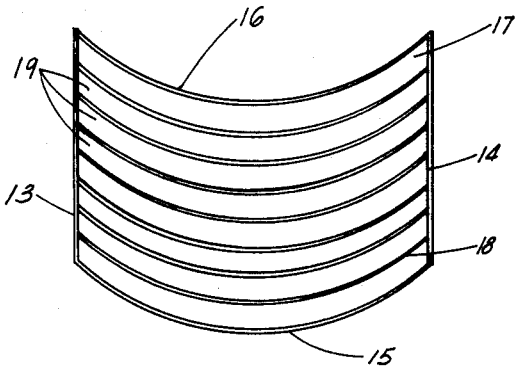
FIG. 2 is a top view of the apparatus of FIG. 1.
Figure 3:
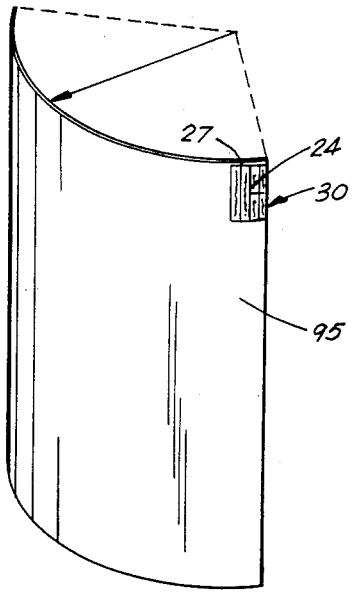
FIG. 3 is a perspective view of a documents with indexing means filed in of the apparatus of FIG. 1.

FIGS. 1–3 illustrate the preferred embodiment of the apparatus of the present invention designated generally by the numeral 10. The problems associated with depositories constructed in accordance with the prior art used for filing flexible sheets or documents are well-known. A typical prior art depository comprises vertical wall members and a plurality of spaced parallel vertical dividers supported between the vertical wall members to divide the depository into a number of sections. The documents or sheets filed in the sections in vertical position on one edge thereof readily bend, buckle or curl thereby occupying more space than necessary in the section. Furthermore, when the documents or sheets become bent, buckled or curled they are either unfit for further use or their potential use is greatly diminished. This disadvantage has been overcome in the past by providing extremely narrow sections in the storage depository wherein the dividers are closely spaced and/or filling the sections with enough documents so that they fit snugly. However, this virtually destroys the utility of the depository.

The problems associated with the prior device can be overcome by providing a depository which allows storage of a document or sheet 95 in the vertical curvilinear form, best illustrated in FIG. 1. Thus, the depository 10 made in accordance with the present invention overcomes the disadvantages of the prior art. As best seen in FIGS. 1 and 3, the apparatus of the present invention 10 for storing flexible sheets or documents 95 is comprised of a base member 12 integrally connected to upstanding parallel side wall members 13, 14. The side members 13, 14 can be flexible and provided with well-known accordian-type portions so that depository 10 can be expandable in a conventional manner should it be made of a flexible paper cardboard material instead of a metal or plastic. Integrally connected to base member 12 and upstanding parallel side wall members 13, 14 are curvilinear-shaped, parallel front and rear wall members 15, 16 so that the depository 10 takes the form of a chamber 17 having an opened upper face.

Apparatus 10 is further provided with a plurality of parallel spaced apart vertical curvilinear dividers 18 which are removable from chamber 17. Curvilinear dividers 18 are positioned between and parallel to front and rear wall members 15, 16 to define a plurality of compartments 19 adapted to retain individual sheets or documents 95 in spaced relation.

Each of the dividers 18 has a means 20 provided thereon for providing an indexing means 30 to the depository 10. The means 20 takes the form of a notch 22 in divider 18 extending inwardly and downwardly from the upper corner 23 of each divider 18. The notch 22 in each of the dividers 18 when the dividers are placed in depository 10 are in substantially the same horizontal and vertical position on each divider 18 as illustrated in FIG. 1.

Indexing means 30 in the preferred embodiment takes the form of a tab 24 securely coupled to each document 95 in the upper right corner thereof so that when apparatus 10 is assembled, each tab 24 is displayed in notch 22 of divider 18. In this way apparatus 10 provides an indexing system for the vertical curvilinear filing of flexible sheets or documents 95 so that they will not bend, sag or curl and can be readily filed, removed or refiled by the desired method, i.e., alphabetical order, subject matter or the like.

In the preferred embodiment, the indexing means 30 may be a conventional elongated plastic container for holding a paper indexing tab within the plastic holder and slipping partially over portion 27 of document 95 which will assume a position adjacent notch 22 and can itself being curvilinear in the direction of its length. Of course, any indexing tab of a flexible material will assume the curvilinear shape of the container.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A depository for storing flexible sheets comprising:

a. a base and upstanding, flexible and expandable parallel side members and curvilinear shaped parallel front and rear members forming a chamber having an open upper face; and b. a plurality of parallel spaced-apart vertical curvilinear dividers cooperating with said side members and positioned between said front and rear members to define a plurality of compartments adapted to retain individual flexible sheets in spaced relation, each of said dividers having a notch formed in the side edge thereof extending inwardly and downwardly from an upper corner thereof, each of said flexible sheets having means provided thereon for detachably securing an indexing means thereto.

2. The apparatus of claim 1 wherein said notches in each of said dividers are at substantially the same position on each of said dividers when said dividers are positioned between said front and rear wall members.

3. The apparatus of claim 1 wherein said indexing means detachably secured to each of said documents includes a tab secured to each of said documents whereby said tab is displayed in said notch of said dividers.

4. The apparatus of claim 3 wherein said indexing means is curvilinear in the direction of its length.

5. A depository for storing flexible sheets comprising:

a. a base and upstanding, flexible and expandable parallel side wall members and curvilinear shaped parallel front and rear wall members forming a chamber having an open upper face;

b. a plurality of parallel spaced-apart vertical curvilinear dividers cooperating with said side wall members and positioned between said front and rear wall members to define a plurality of compartments adapted to retain individual flexible sheets in spaced relation, each of said dividers having a notch formed in the side edge thereof extending inwardly and downwardly from an upper corner thereof, each of said flexible sheets having means provided thereon for detachably securing an indexing means thereto, said indexing means secured to said flexible sheets and including a tab secured to each of said sheets whereby said tabs are displayed in said notches of said dividers.

6. The apparatus of claim 5 wherein said notch in each of said dividers is provided at substantially the same horizontal and vertical position of said dividers when positioned between said front and rear wall members.

7. The apparatus of claim 5 wherein said indexing means are curvilinear in the direction of their length.

8. A depository for storing flexible sheets comprising:

a. a base and upstanding, flexible and expandable parallel side wall members and curvilinear shaped parallel front and rear wall members forming a chamber having an open upper face;

b. a plurality of parallel spaced-apart vertical curvilinear dividers cooperating with said side wall members and positioned between said front and rear wall members to define a plurality of compartments adapted to retain individual flexible sheets in spaced relation, each of said dividers having a side edge formed with a notch therein extending inwardly and downwardly from an upper corner thereof, said notches being in substantially the same position on each of said dividers when positioned between said front and rear wall members; and c. indexing means detachably secured to each of said sheets, said indexing means including a tab detachably secured to each of said flexible sheets at a corner thereof whereby said tabs are displayed in said notches of said dividers.

9. The apparatus of claim 8 wherein said indexing means are curvilinear in their direction of length.

* * * * *